US005636838A

United States Patent [19]

Caro

[11] Patent Number: 5,636,838

[45] Date of Patent: Jun. 10, 1997

[54] APPARATUS AND METHOD OF PLAYING A ROULETTE GAME USING A ROULETTE WHEEL HAVING TWO INDEPENDENTLY ROTATABLE PLATES AND USING TWO SEPARATE WAGERING AREA

[75] Inventor: Jean B. Caro, Paris, France

[73] Assignee: Richard M. Fitoussi, Las Vegas, Nev.

[21] Appl. No.: 311,777

[22] Filed: Sep. 23, 1994

[51] Int. Cl.[6] ..... A63F 5/00; A63F 5/02

[52] U.S. Cl. ..... 273/142 E; 273/142 H; 273/142 HA; 273/142 J; 273/274

[58] Field of Search ..... 273/142 E, 142 HA, 273/142 A–142 H, 142 J, 142 JA, 142 JB, 142 JC, 142 JD, 143 R, 143 C, 143 D, 143 E

[56] References Cited

U.S. PATENT DOCUMENTS

| | | | |
|---|---|---|---|
| 1,578,412 | 3/1926 | Ewig | 273/142 E |
| 2,095,367 | 10/1937 | Mattson | 273/142 HA |
| 2,803,464 | 8/1957 | Nackers | 273/142 C |

FOREIGN PATENT DOCUMENTS

| | | | |
|---|---|---|---|
| 829381 | 6/1938 | France | 273/142 E |
| 1189314 | 10/1959 | France | 273/142 E |
| 3702880 | 8/1988 | Germany | 273/142 E |
| 67114 | 2/1940 | Italy | 273/142 E |
| 559858 | 8/1957 | Netherlands | 273/142 E |

*Primary Examiner*—Benjamin H. Layno
*Attorney, Agent, or Firm*—Galgano & Burke

[57] ABSTRACT

Methods and apparatus are provided for a roulette-type game comprising two sets of concentric indicia. According to a preferred embodiment, players may wager on either set of indicia and on the occurrence of the same indicia from both sets of indicia being indicated. A preferred roulette table comprises two independently rotatable plates each bearing identical indicia, and a mechanism for accurately aligning the indicia from the inner plate with indicia on the outer plate when the plates are not in relative motion.

20 Claims, 4 Drawing Sheets

APPARATUS AND METHOD OF PLAYING A ROULETTE GAME USING A ROULETTE WHEEL HAVING TWO INDEPENDENTLY ROTATABLE PLATES AND USING TWO SEPARATE WAGERING AREA

The present invention is directed to methods and apparatus for playing a wagering game and, more particularly, to a roulette-type game.

BACKGROUND OF THE INVENTION

Roulette is a popular game that is played in casinos throughout the world. Roulette has been very popular for years. It provides players with a variety of wagering options and opportunities to collect large payouts.

Patrons of casinos often enjoy new games, particularly games which offer greater payouts.

It is therefore desirable to provide a modified form of roulette which offers players additional wagering opportunities and chances of receiving payouts which are significantly higher than provided in conventional roulette games.

SUMMARY OF THE INVENTION

The various aspects of the present invention provide novel methods and apparatus for playing a roulette-type game. According to one preferred embodiment of the present invention, a playing station is provided comprising a roulette wheel having two, independently-rotatable numbered wheels and a plurality of wagering areas. According to this embodiment of the present invention, the numbered wheels are rotated while a ball is spun within an outer track of a support housing and eventually comes to rest within a pocket aligned with numbers on the two wheels. The betting areas of this embodiment of the present invention permit a player to bet on the numbers of either and/or both the inner and outer ring numbers. Since the likelihood of the balls stopping in a pocket aligned with the same number in the inner ring and outer ring is very small, the winning payout to a player having made that wager is significantly higher than a winning payout for a successful choice of a single number.

According to another embodiment of the present invention, only one of the numbered wheels is rotatably mounted.

According to a preferred embodiment, a mechanism is provided on the bottom of the wheels to ensure careful alignment of the numbers in the inner wheel with the numbers on the outer wheel.

One novel method of the present invention comprises playing a roulette-type game on an apparatus described herein, wherein, the player may place a wager on at least one inner number, at least one outer number and/or the occurrence of the same inner and outer number aligned with the pocket in which the ball stops.

DETAILED DESCRIPTION OF THE PREFERRED EMBODIMENTS

Figure 1:
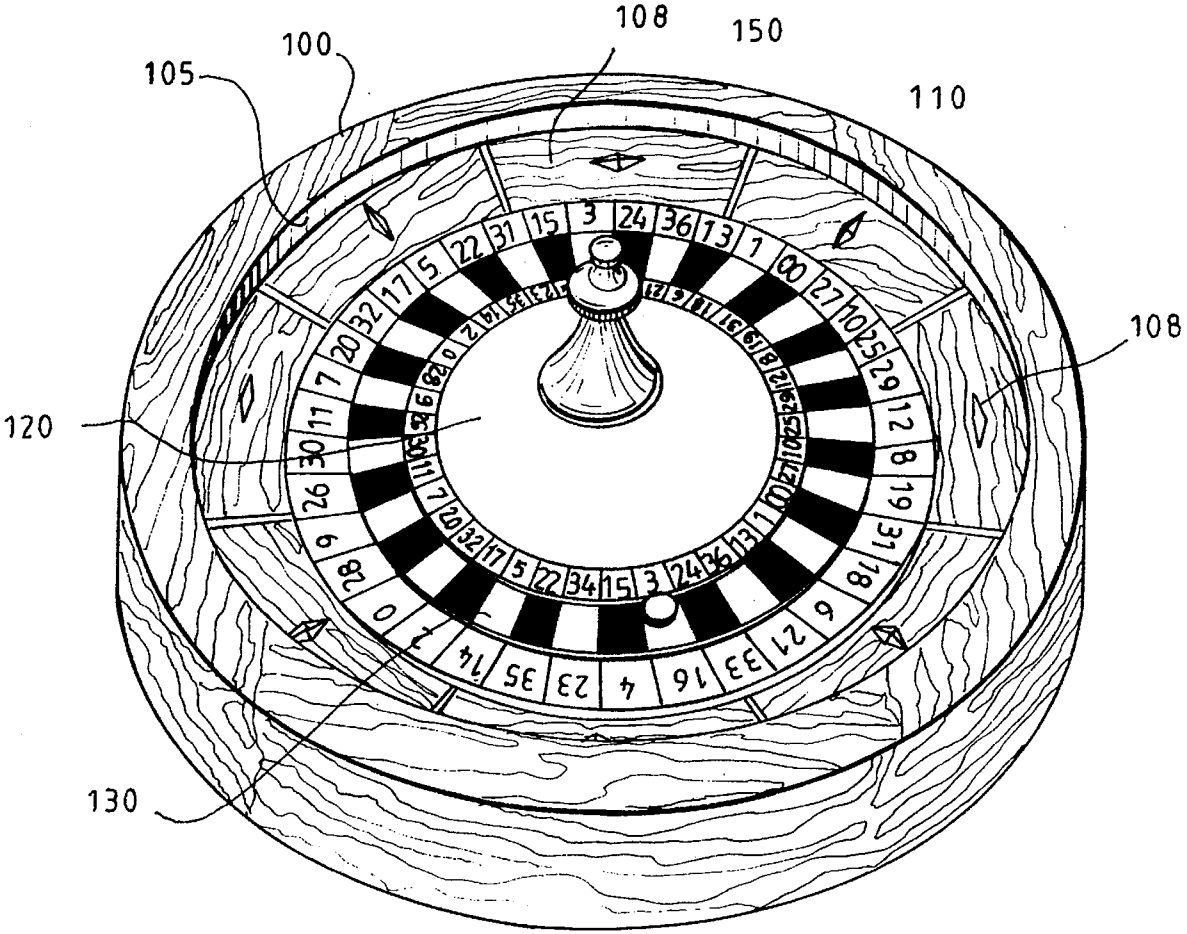
FIG. 1 is a perspective view of a playing apparatus of one embodiment of the present invention.

The various embodiments provide novel apparatus and methods of playing roulette-type games. One preferred embodiment, shown in FIGS. 1–4, comprises a numbered selector having a support 100, a rotatable outer wheel 110, and an inner rotatable wheel 120. In the illustrated embodiment, both the outer wheel 110 and inner wheel 120 are provided with identical sets of numbers including the numbers one-to-thirty six, zero and double zero. In this illustrated embodiment, the numbers are advantageously arranged concentrically about the rotating axis of the wheels on either side of a ring of pockets 130. Each pocket 130 is designed to contain ball 140 in a manner well known to those skilled in the art. The ring of pockets 130 in the illustrated embodiment is formed as part of inner ring 120, though those skilled in the art will appreciate that the pockets could readily be formed as part of outer ring 110, or even as an independently fixed or movable ring. A central handle 150 is provided at the center of both numbered rings and is preferably rigidly connected to inner ring 120.

During operation, inner ring 120 can be spun in one direction while outer ring 110 is spun either in the same direction or in counter-rotation. Ball 140 is then directed around the upper, inner rim of support 100 in a manner well known in the art. As ball 140 looses momentum, it falls down the angled inner sidewalls 108, over outer ring 110 and eventually into a pocket 130.

Since the roulette wheel of the present invention is specifically designed for permitting the simultaneously drawing of two numbers, it is important that the numbers and compartments on the inner ring 120 are precisely aligned with the numbers on outer ring 110. In order to ensure proper alignment, an aligning mechanism is advantageously provided in a preferred embodiment.

Figure 2:
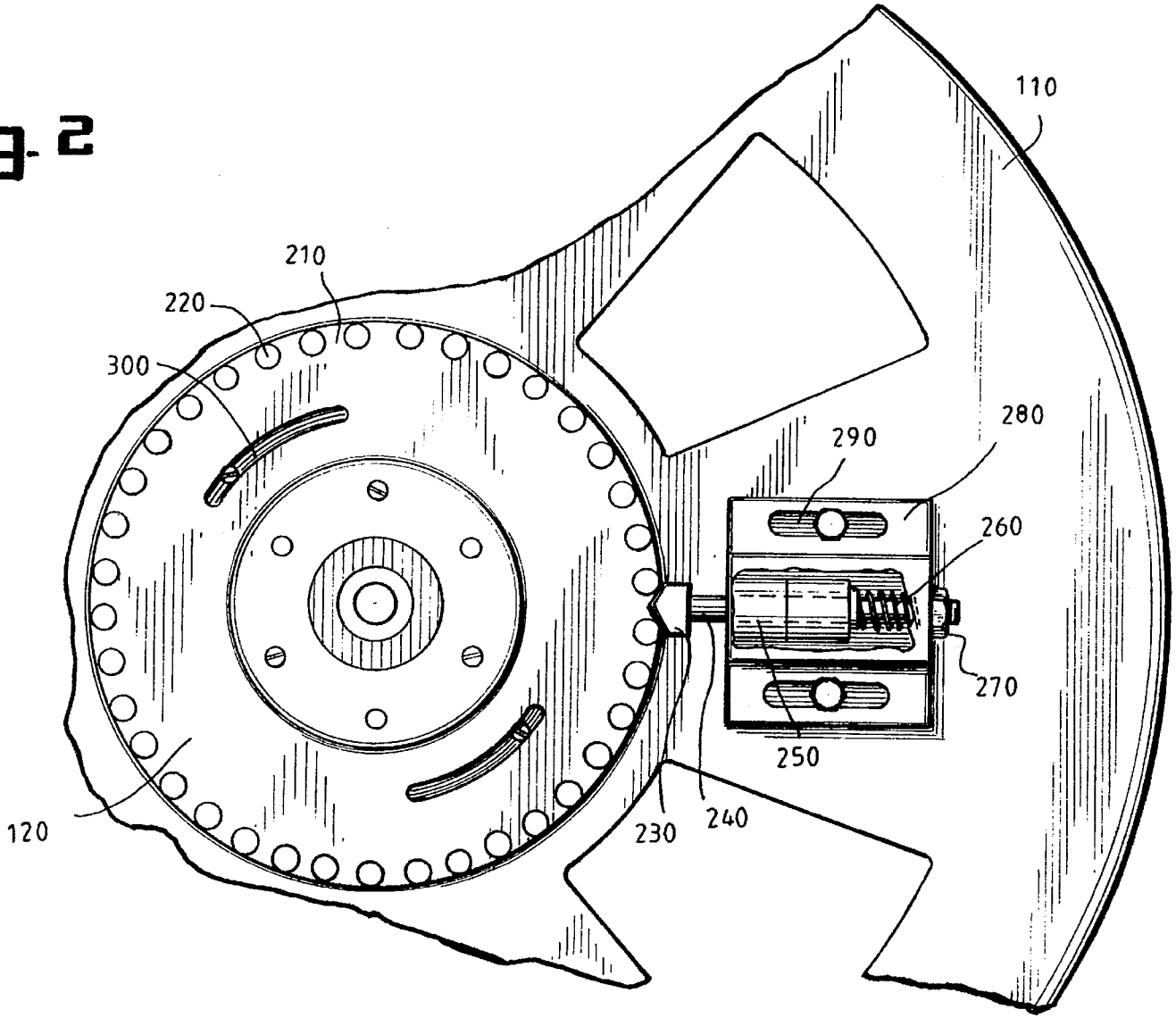
FIG. 2 is a partial, bottom view of an aligning mechanism of one embodiment of the present invention.
Figure 3:
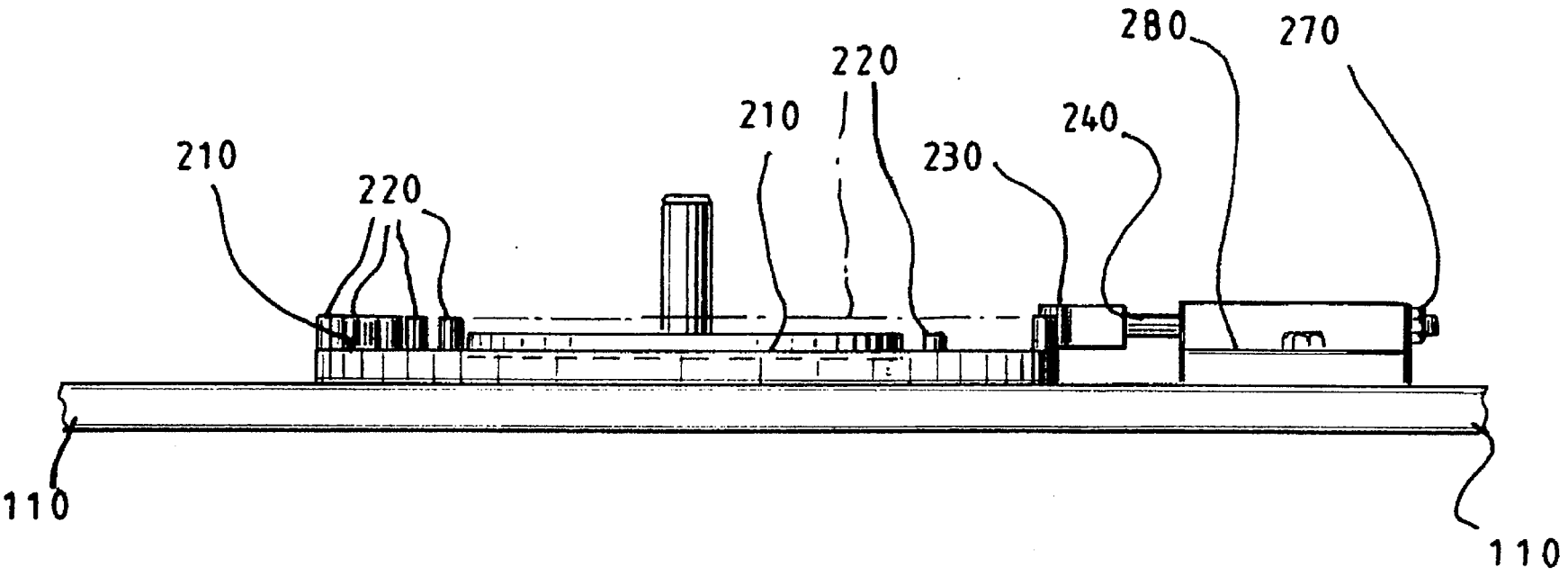
FIG. 3 is a side view of the aligning mechanism shown in FIG. 2.

FIGS. 2 and 3 illustrate one embodiment of an aligning mechanism of the present invention. With reference to FIGS. 2 and 3, the bottom of inner ring 120 is provided with a plurality of pins 220 defining spaces 210. The number of spaces 210 corresponds to the number of indicia and pockets on the top of the rings. Each pin 220 is preferably provided with a shaft equipped with a miniature precision ball bearing (not shown) in order to facilitate rotation of the pin. The ability of pins 220 to rotate decreases the effects of friction and braking and facilitates the positioning of a feeler 230.

On the bottom of outer ring 110, connected by suitable mounting brackets 280, is a feeler 230 mounted upon a shaft 240 which is connected to a support housing by bearings 250 and a coil spring 260. Spring biased shaft 240 urges feeler 250 in the direction of the center of concentrically arranged pins 220. The forward edge of feeler 230 is advantageously bevelled in order to promote smooth positioning of feeler 230 between two pins 220 when relative motion between outer plate 110 and inner plate 120 ceases. From FIGS. 2 and 3 it will be appreciated by those skilled in the art that the ability of pins 220 to rotate and the bevelled distal end of feeler 230 facilitates the positioning of feeler 230 between two pins 220 as the inner and outer plates loose relative angular velocity. The force exerted by coil spring 260 is advantageously adjustable by a break nut 270. Additionally, in order to adjust the force applied by feeler 230 to rotating pins 220, the mounting plate of the feeler assembly is advantageously provided with slots 290 so that the entire feeler assembly can be moved closer to or further from inner plate 120 as desired. Furthermore, in order to allow the precise relative alignment of the inner plurality of indicia and the outer plurality of indicia, the bottom of inner plate 120 is provided with two elongated holes 300 allowing the angular adjustment of the pins 220 relative to the feeler 230.

The drawings are merely provided for purposes of illustration. Those skilled in the art will appreciate that the actual number of spaces 210 between pins 220 must correspond exactly to the number of indicia appearing on the top of outer plate 110 and inner plate 120.

While the illustrated embodiment of the present invention is provided with the numbers one-to-thirty six, zero and double zero, any suitable indicia including letters, characters or other symbols may be also utilized within the scope of the present invention. It is also not necessary that both the inner plate 120 and outer plate 110 rotate in order for a player to be provided with all of the wagering options described herein.

It will also be appreciated that the indicia appearing in the inner and outer pluralities of indicia need not be identical. For the purposes of one embodiment of the present invention, it will suffice if some of the indicia in the inner and outer pluralities are identical to provide at least one player with an opportunity to wager on the occurrence of the same indicia being indicated. It will be appreciated by those skilled in the art that it is more preferable to provide an apparatus wherein at least a majority of the indicia on the inner and outer concentric arrangements are identical to provide a large selection of wagering options to players wishing to wager on a large payout.

While the illustrated embodiments comprises a number of pockets disposed on the inner plate 120, it would also be within the scope of the present invention to provide a further independently rotatable plate. This would of course complicate the construction of this gaming apparatus and require a further mechanism to ensure proper alignment of both sets of indicia and the corresponding pocket. It is also possible to simply form a separation grill having equally sized pockets wherein the separation grill is originally attached to one of the plates in order to define the pockets.

While the alignment mechanism of the illustrated embodiment of the present invention is positioned at the bottom of the inner and outer plates, it is also within the scope of the present invention to position an alignment mechanism on top of the apparatus. It is also well within the scope of the present invention to position the pins on the outer plate while positioning the feeler mechanism on the inner plate.

The material used to form the various elements of the present invention are well within the scope of those skilled in the art. For example, the plates may be formed of a metal or non-metallic material. Similarly, the pins may be formed of any sufficiently rigid and wear-resistant material such as a ferrous or non-ferrous alloy or a plastic material.

Figure 4:
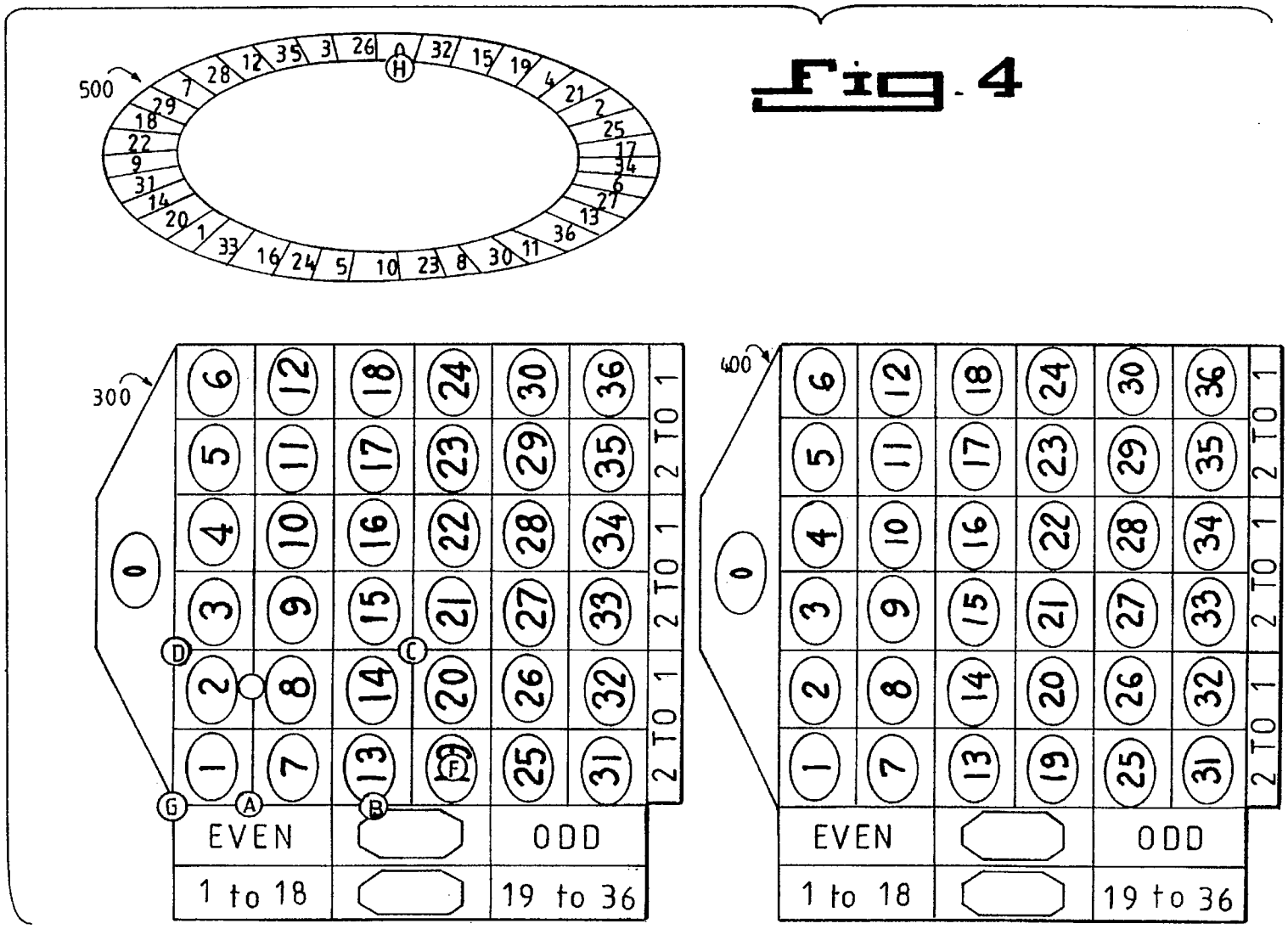
FIG. 4 is a top view of preferred wagering areas used with the apparatus of FIG. 1.

FIG. 4 illustrates a preferred wager area layout. The illustrated layout is designed for two identical wager areas comprising numerals zero through thirty six. According to this preferred embodiment, the layout area 300 is designed to receive wages for an inner plate while layout area 400 is designed for receiving wages corresponding to indicia on the outer plate. In accordance with the advantages of the present invention, layout area 500 is designed to receive wages wherein the person wagering hopes that the same number will come up on both the inner and outer plates.

While the payouts provided for a winning wager can vary as desired, the following provides one example of a winning payout schedule that is useful with the wagering areas shown in FIG. 4. The letters A through H correspond to the areas indicated on FIG. 4.

A 2:1 PAYOFFS—Any of Twelve Numbers
B 5:1 PAYOFFS—Any of Six Numbers
C 8:1 PAYOFFS—Any of Four Numbers
D 11:1 PAYOFFS—Any of Three Numbers
E 17:1 PAYOFFS—Any of Two Numbers
F 35:1 PAYOFFS—Any Single Number
G 4:1 PAYOFFS—Any Seven Numbers
H 1200:1 PAYOFFS—Any Identical Numbers on Both Wheels

What is claimed is:

1. A roulette-type gaming device comprising:

a support structure a first plurality of indicia arranged in a substantially circular fashion on a first rotatable carrier, said carrier operatively connected to said support structure and rotatable about a central axis;

a second plurality of indicia arranged concentrically with respect to said first plurality of indicia;

a plurality of pockets arranged concentrically with respect to said first plurality of indicia;

an indicator movably disposed relative to said rotatable carrier and dimensioned to be received within one of said pockets to indicate a first winning indicia from said first plurality of indicia and a second winning indicia from said second plurality of indicia; and means for aligning indicia of said first plurality of indicia with indicia of said second plurality of indicia, said aligning means comprising a plurality of spaced apart pins positioned relative to one of said plurality of indicia and a movable plunger which abuts at least one of said pins, and said pins being rotatable thereby reducing friction and braking effects caused from interaction between said pins and said plunger.

2. A roulette-type gaming device according to claim 1 wherein said second plurality of indicia are arranged on a second rotatable carrier.

3. A roulette-type gaming device according to claim 1 wherein said moveable plunger abuts two of said pins to align said indicia of said first plurality of indicia with indicia of said second plurality of indicia.

4. A roulette-type gaming device according to claim 3 wherein said plunger is movable radially with respect to said concentrically arranged indicia.

5. A roulette-type gaming device according to claim 1 wherein a majority of said indicia of said first plurality of indicia are also in said second plurality of indicia.

6. A roulette-type gaming device according to claim 5 wherein said indicia of said first plurality of indicia are identical with said indicia of said second plurality of indicia.

7. A roulette-type gaming device according to claim 6 wherein said indicia of said first plurality of indicia are arranged in an order opposite to the order of arrangement of said indicia of said second plurality of indicia.

8. A roulette-type gaming device according to claim 1 wherein said indicator is a ball.

9. A roulette-type gaming device according to claim 1 further comprising means for providing at least one player with the opportunity to wager on whether said indicator will indicate a particular indicia from said first plurality of indicia, a particular indicia from said second plurality of indicia and/or common indicia from each of said pluralities of indicia.

10. A roulette-type gaming device according to claim 1 wherein said first plurality of indicia comprises only a single occurrence of each indicia thereon.

11. The roulette-type gaming device according to claim 1, wherein said aligning means includes an operatively connected spring to bias said movable plunger toward said pins.

12. The roulette-type gaming device according to claim 11, wherein said aligning means further includes means for adjusting the force exerted between said plunger and said pins.

13. The roulette-type gaming device according to claim 12, wherein said pins include an operatively connected ball bearing to facilitate rotation of the pin.

14. A roulette-type gaming device comprising:

a support structure;

a first plurality of indicia arranged in a substantially circular fashion on a first rotatable carrier, said carrier operatively connected to said support structure and rotatable about a central axis;

a second plurality of indicia arranged concentrically with respect to said first plurality of indicia;

a plurality of pockets arranged concentrically with respect to said first plurality of indicia;

an indicator movably disposed relative to said rotatable carrier and dimensioned to be received within one of said pockets to indicate a first winning indicia from said first plurality of indicia and a second winning indicia from said second plurality of indicia; and a first separate wagering area corresponding to said first indicia and a second separate wagering area spaced from said first area corresponding to said second indicia.

15. A roulette gaming device according to claim 14, further comprising:

means for aligning indicia of said first plurality of indicia with indicia of said second plurality of indicia.

16. A roulette-type gaming device according to claim 14 wherein a majority of said indicia of said first plurality of indicia are also in said second plurality of indicia.

17. A roulette-type gaming device according to claim 16 wherein said indicia of said first plurality of indicia are identical with said indicia of said second plurality of indicia.

18. A roulette-type gaming device according to claim 17 wherein said indicia of said first plurality of indicia are arranged in an order opposite to the order of arrangement of said indicia of said second plurality of indicia.

19. A roulette-type gaming device according to claim 14 further comprising means for providing at least one player with the opportunity to wager on whether said indicator will indicate a particular indicia from said first plurality of indicia, a particular indicia from said second plurality of indicia and/or common indicia from each of said pluralities of indicia.

20. A method of playing a game comprising the steps of:

providing a gaming device comprising;

a support structure, a first plurality of indicia in a substantially circular fashion arranged on a first rotatable carrier, said carrier operatively connected to said support structure and rotatable about a control axis;

a second plurality of indicia arranged concentrically with respect to said first plurality of indicia;

a plurality of pockets arranged concentrically with respect to said first plurality of indicia;

an indicator movably disposed relative to said rotatable carrier and dimensioned to be received within one of said pockets to indicate a first winning indicia from said first plurality of indicia and a second winning indicia from said second plurality of indicia;

a first separate wagering area corresponding to said first plurality of indicia and a second separate wagering spaced from said first area area corresponding to said second plurality of indicia;

displaying a payout schedule comprising at least a first payout for the occurrence of said indicator indicating a particular indicia from said pluralities of indicia and a second payout for the occurrence of said indicator indicating the same indicia on both said first plurality and said second plurality of indicia, providing at least one player with an opportunity to make a wager, causing said indicator to randomly indicate indicia from both of said pluralities of indicia; and providing a winning payout to a player if said player successfully wagered on the occurrence of said indicator indicating one or more of said indicia.

* * * * *